US007942091B2

(12) United States Patent
Winge

(10) Patent No.: US 7,942,091 B2
(45) Date of Patent: May 17, 2011

(54) SHOTGUN DRUM MAGAZINE

(76) Inventor: Michael L. Winge, Boonville, IN (US)

( * ) Notice: Subject to any disclaimer, the term of this patent is extended or adjusted under 35 U.S.C. 154(b) by 389 days.

(21) Appl. No.: 12/151,480

(22) Filed: May 7, 2008

(65) Prior Publication Data

US 2010/0293830 A1 Nov. 25, 2010

Related U.S. Application Data

(60) Provisional application No. 60/928,219, filed on May 8, 2007.

(51) Int. Cl.
*F41A 9/73* (2006.01)

(52) U.S. Cl. ..... 89/33.02

(58) Field of Classification Search ..... 89/33.02, 89/33.16, 33.17; 42/19, 49.01, 60
See application file for complete search history.

(56) References Cited

U.S. PATENT DOCUMENTS

| | | | | | |
|---|---|---|---|---|---|
| 1,719,127 | A * | 7/1929 | Pfeiffer et al. | ..... | 89/33.17 |
| 4,138,923 | A * | 2/1979 | Brosseau et al. | ..... | 89/33.02 |
| 4,487,103 | A * | 12/1984 | Atchisson | ..... | 89/33.02 |
| 4,658,700 | A * | 4/1987 | Sullivan | ..... | 89/33.02 |
| 4,689,907 | A * | 9/1987 | Gwinn, Jr. | ..... | 42/50 |
| 4,745,842 | A * | 5/1988 | Shou-Fu | ..... | 89/33.02 |
| 4,926,742 | A * | 5/1990 | Ma et al. | ..... | 89/33.02 |
| 5,600,083 | A * | 2/1997 | Bentley et al. | ..... | 89/33.02 |
| 2007/0151440 | A1 * | 7/2007 | Cook et al. | ..... | 89/33.17 |

* cited by examiner

*Primary Examiner* — Bret Hayes
(74) *Attorney, Agent, or Firm* — Gary K. Price

(57) ABSTRACT

A magazine for shotgun shells for use with a shotgun including an open frame housing having a generally flat front and a generally flat rear portion connected and separated by spacers. The flat front and flat rear portions each include an annular groove, the annular groove forming an annular path along which the shells travel. A rotatably mounted cog wheel for carrying the shells along the annular path and a coil spring for rotating the cog wheel such that shells can be manually loaded into the magazine against a force generated against the spring and automatically dispensed by the spring.

17 Claims, 7 Drawing Sheets

SHOTGUN DRUM MAGAZINE

CROSS REFERENCES TO RELATED APPLICATIONS

U.S. Provisional Application for Patent No. 60/928,219, filed May 8, 2007, with title "Shotgun Drum Magazine" which is hereby incorporated by reference. Applicant claims priority pursuant to 35 U.S.C. par. 119(e)(i).

STATEMENT AS TO RIGHTS TO INVENTIONS MADE UNDER FEDERALLY SPONSORED RESEARCH AND DEVELOPMENT

Not Applicable

BACKGROUND OF THE INVENTION

1. Field of the Invention

This invention relates to magazines for supplying shells to a shotgun.

2. Brief Description of Prior Art

Conventional shotguns have a limited number of shells that can be loaded, usually five or six shells. The limited number of shots is not adequate for certain applications including military use and target shooting, for example.

As will be seen from the subsequent description, the preferred embodiments of the present invention overcome disadvantages of the prior art.

SUMMARY OF THE INVENTION

In accordance with the present invention, a drum magazine is disclosed for use in conjunction with a shotgun. More particularly, the drum magazine for shotgun shells is for use with a shotgun and includes an open frame housing having a generally flat front and a generally flat rear portion connected and separated by spacers. The flat front and flat rear portions each include annular grooves, the annular grooves forming an annular path along which the shells travel. The drum magazine further includes a rotatably mounted cog wheel for carrying the shells along the annular path and a coil spring for rotating the cog wheel such that shells can be manually loaded into the magazine against a force generated against the spring and automatically dispensed by the spring.

DESCRIPTION OF THE PREFERRED EMBODIMENT

Figure 1:
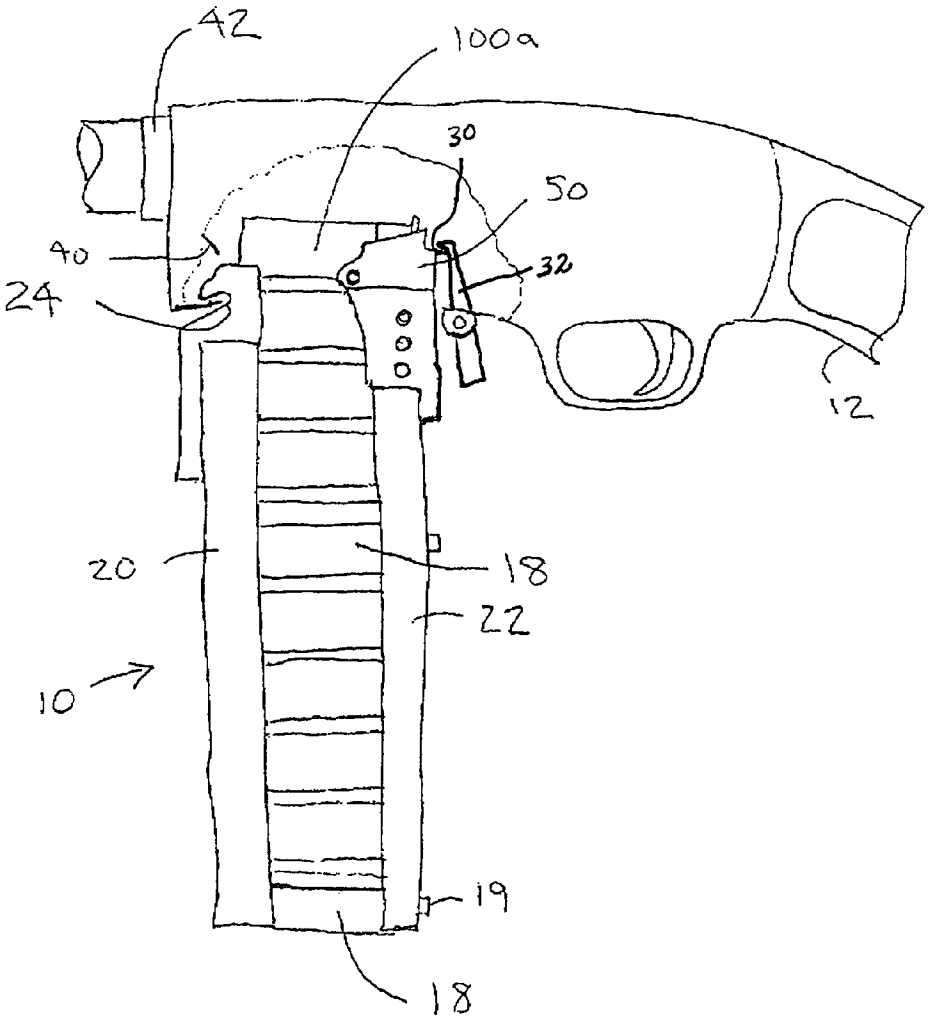
FIG. 1 is a preferred embodiment of the present invention, a shotgun drum magazine.

In accordance with the present invention, a shell magazine 10 for use in conjunction with a shotgun 12 is disclosed. The shell magazine 10 includes a generally flat front plate 20 and a generally flat rear plate 22 spaced apart by at least three (3) spacers 18 and held together by bolts 19. The magazine 10 includes a front groove 24 that cooperates with a projection on the shotgun 12 to partially lock the magazine 10 in place on the gun 12. The rear plate 22 includes a catch 30 that cooperates with a pivotable finger 32 to hold the rear portion of the magazine 10 in the gun 12.

In FIG. 1, a portion of the gun 12 is shown cut-away for clarity. As can be seen, a shell 100A is presented at the top of the magazine 10. When firing the gun 12, the shell 100A will slide up ramp 40 and into the upper portion of the gun 12 for firing through barrel 42 of the gun 12. The upper portion of the magazine 10 includes a pivotable clip 50 that serves the dual purpose of holding the shells 100A and the magazine 10 when it is not mounted to the gun 12 and releasing the shells 100A when the magazine 10 is locked into the gun 12.

Figure 2:
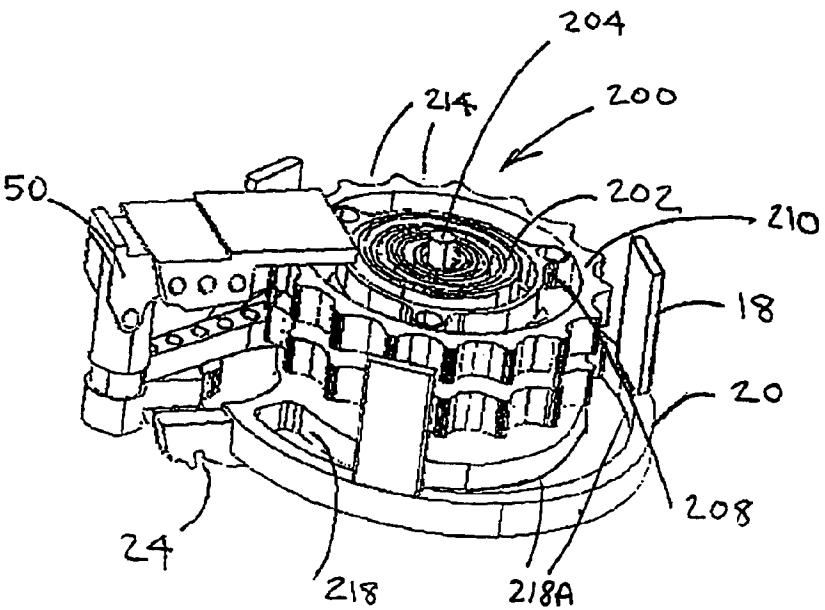
FIG. 2 is a partial view of the embodiment of FIG. 1.
Figure 6:
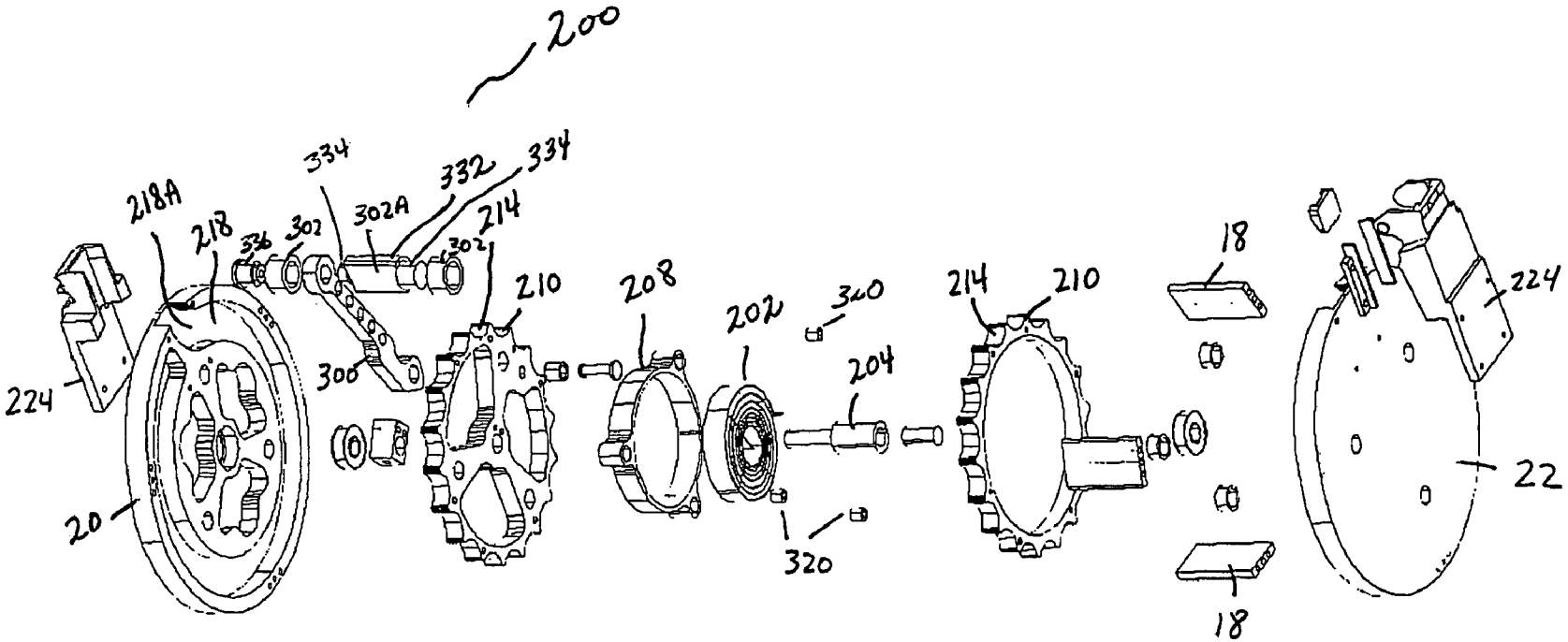
FIG. 6 is an exploded view of the device of FIG. 1.

FIG. 2 shows details of the magazine 10 and the front plate 20. The rear plate 22 has been removed to expose the inner spring drive 200 of the magazine 10. FIG. 6 shows further details of the inner spring drive 200. The spring drive 200 includes a coil spring 202 that can be wound by manually pressing shells 100 into the magazine 10. The spring 202 is around and attached to the fixed axle 204 and contained in spring retainer housing 208. The spring 202 drives two cog wheels 210 that include aligned shell engaging grooves 214 that engage the bodies of the shells 100 that are loaded in the magazine 10. The front plate 20 includes annular groove 218 that defines a track 218A that provides a path for shells 100 to follow as they are loaded into the magazine 10 and as they are released during firing of the gun 12. It will be understood that the rear plate 22 includes an aligned and cooperating grove 219 that contains the opposite ends of each shell 100. The grooves 218, 219 combined form the path along which shells 100 travel. The track 218A in the annular groove 218 is for receipt of a rim (not shown) of a standard shell 100.

Figure 3:
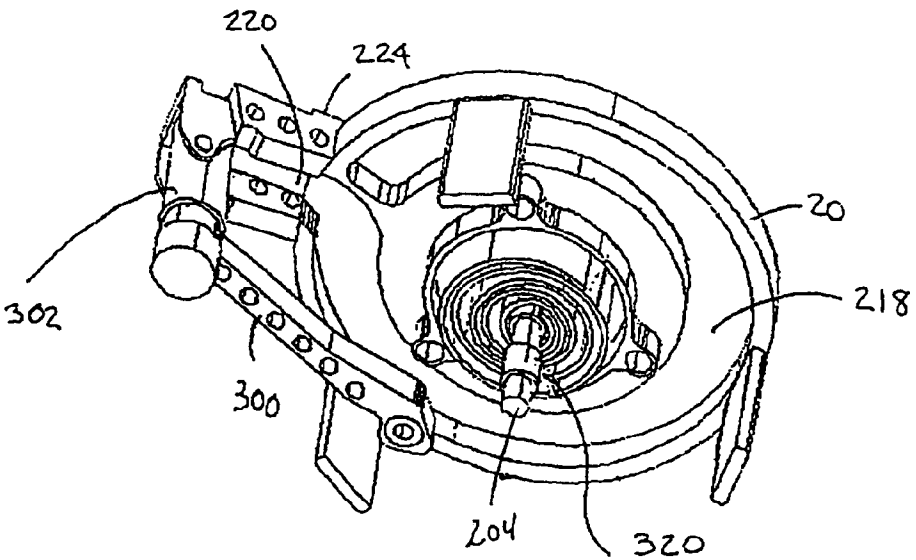
FIG. 3 is a partial view of the embodiment of FIG. 1.

FIG. 3 shows a view of the magazine 10 and front plate 20 with the rear plate 22 and cogs 210 removed. The view shows the annular groove 218 that provides a nearly circular path for shells 100 terminating in a straight path portion 220 in a feed tower portion 224 of the magazine 10. The pivotable follower arm 300 is normally attached to the cogs 210 for motion therewith and includes a cut-away 302A (shown in FIGS. 4-7) for communication with the cogs 210. With the cogs 210 removed, it becomes clear that a spacer 320 helps maintain the cogs 210 in spaced relation on the axle 204.

Figure 7:
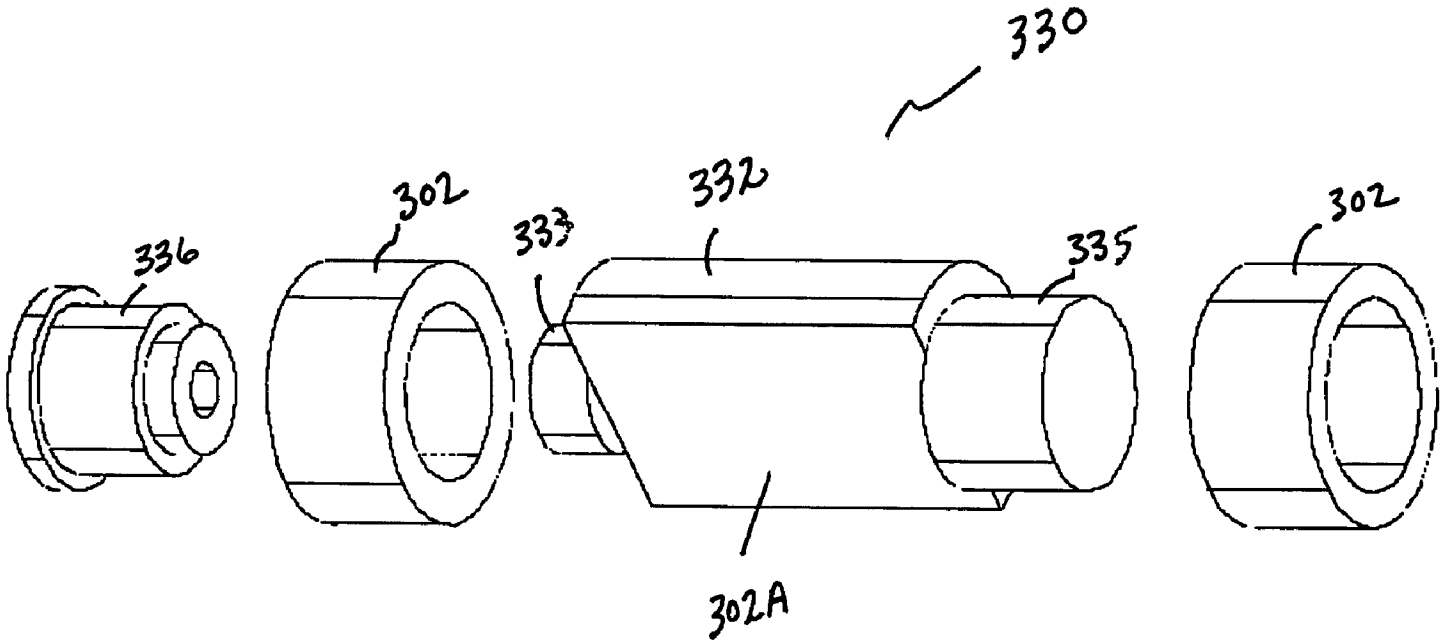
FIG. 7 is an exploded view of the magazine follower.

The follower arm 300 includes a follower 330 having a body 332, the body 332 having a pivot arm 333 extending from one end and an extension 335 extending from the opposite end. The body 332 is sized to match a shell and includes the cut-away 302A that defines a flat surface that extends the longitudinal length of the body 332. As best illustrated in FIG. 7, about 40% of the body 332 is removed to form the cut-away 302A. The cut-away 302A prevents the follower 330, as it travels along the defined path as shells are unloaded and loaded in the magazine 10, from jamming against the high point of the shell engaging grooves 214, and allows the follower 330 to clear the high point of the engaging grooves 214 as the follower 330 travels within the magazine 10.

A nose axel 336 is rotatably attached to the pivot arm 333, and bearings 302 cover the axle 336 and the extension 335. In the preferred embodiment, the follower 330 is shaped similar to a shell 100 and the axle 336 and bearings 302 rotate freely along the path 218 and follow the shells in path 218 and drives the shells 100 from the magazine 10 during the firing of the gun 12. FIG. 7 is an exploded view of the magazine follower 330. The follower 330 is mounted to the arm 300 and the arm 300 is rotatably mounted to the cogs 210.

Figure 4:
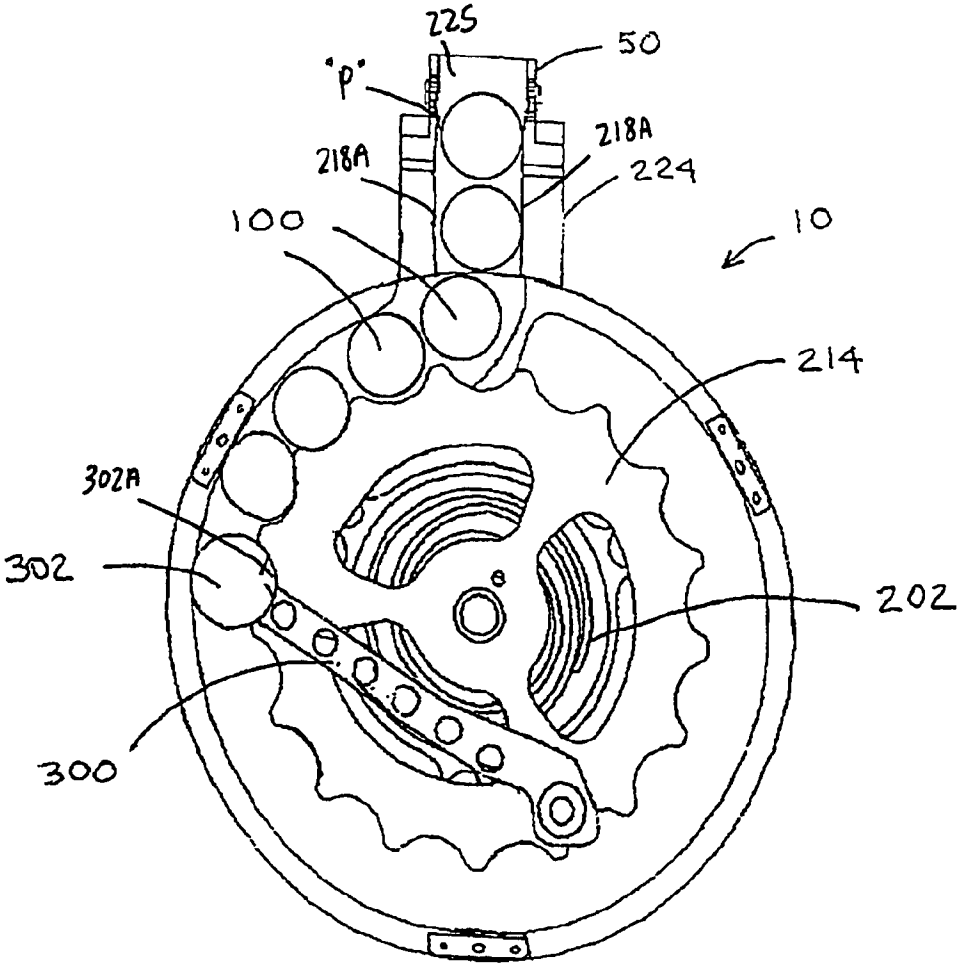
FIG. 4 is a partial view of the embodiment of FIG. 1.

FIG. 4 shows another partial cut-away view of the magazine 10. FIG. 4 shows shells 100 loaded into the magazine 10. As a user presses shells 100 into the feed tower portion 224, the bearings 302 is forced backwards, counterclockwise, as shown in FIG. 4, winding the spring 202. The pivotable clip 50 maintains the shells 100 in the magazine 10. The track 218A as previously discussed is further defined along the feed tower portion 224 and terminates at point "P". The tower portion 224 further includes an end ramp 225 to assist in releasing the shell 100.

Figure 5:
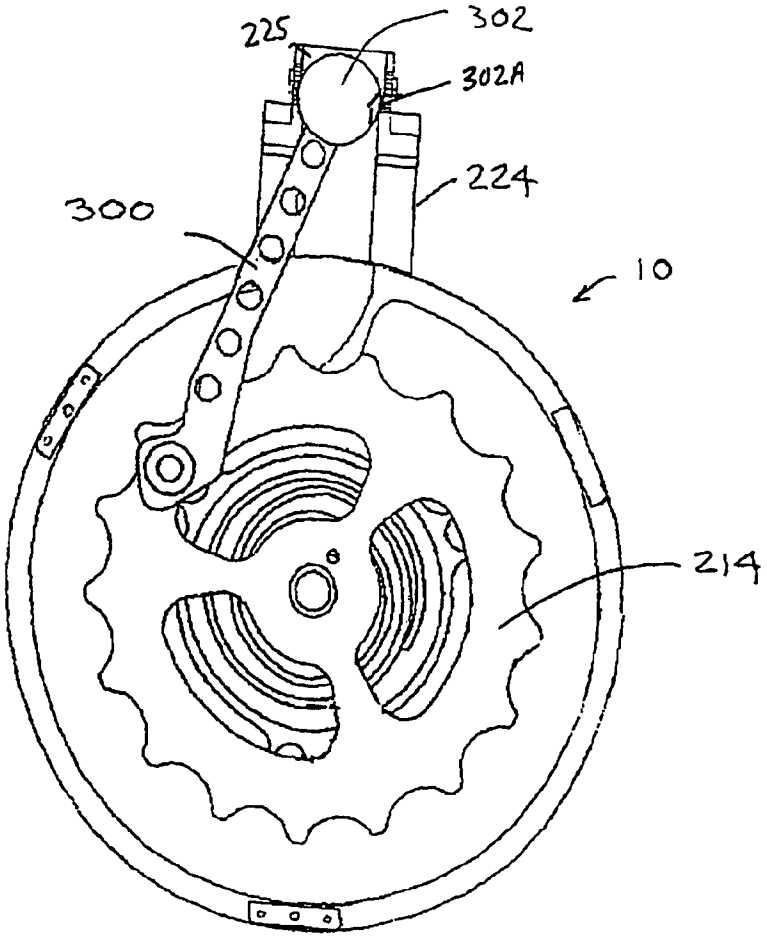
FIG. 5 is another partial view of FIG. 1.

FIG. 5 shows the magazine 10 with all the shells 100 dispensed such that the bearings 302 is at the top of the feed tower portion 224. When shells 100 are forced into the magazine 10, it winds the spring 202 which can then return the energy stored as it drives the shells 100 back out of the magazine 10.

Although the description above contains many specificities, these should not be construed as limiting the scope of the invention but as merely providing illustrations of some of the presently preferred embodiments of this invention.

It would be obvious to those skilled in the art that modifications be made to the embodiments described above without departing from the scope of the present invention. Thus the scope of the invention should be determined by the appended claims in the formal application and their legal equivalents, rather than by the examples given.

I claim:

1. A shotgun drum magazine for supplying shotgun shells to a shotgun, said shotgun drum magazine comprising:

an open frame housing having a generally flat front plate and a generally flat rear plate connected and separated by spacers, bolts in said spacers and openings between the spacers, the flat front plate including a first annular groove providing a track for shotgun shell rims and said track terminates at an end ramp and the flat rear plate including a second annular groove aligned with the first annular groove, said second annular groove receiving a shotgun shell end opposite said rim, wherein said first and second annular grooves forming an annular path along which shotgun shells travel, a rotatably mounted cog wheel having output grooves sized to engage shotgun shells for carrying shotgun shells along the annular path, and a coil spring for rotating the rotatably mounted cog wheel such that shotgun shells can be manually loaded into the magazine against a force generated against said spring and automatically dispensed by said spring, a follower arm having a first end pivotably mounted on said rotatably mounted cog wheel, said follower arm having a second end carrying a body that is carried in one of said first and second annular grooves, wherein said body includes a bearing that defines a cut-away for communication with said rotatable mounted cog wheel.

2. The shotgun drum magazine as recited in claim 1, wherein said end ramp connects to a shotgun, and shotgun shells exit said magazine through said end ramp.

3. The shotgun drum magazine as recited in claim 1, wherein said flat front plate includes a slot that cooperates with a projection on a shotgun to support said magazine on a shotgun.

4. The shotgun drum magazine as recited in claim 1, wherein said body is rotatable with said cog wheel, and wherein said body is carried in said first and second annular grooves and wherein said body is rotatable within said first and second annular grooves.

5. The shotgun drum magazine as recited in claim 4, wherein said body is carried on an end of an arm pivotably mounted to said cog wheel.

6. A gun drum magazine for supplying gun shells to a gun, said gun drum magazine comprising:

a housing having a flat front and a flat rear plate connected and separated by spacers, the flat front plate including a first annular groove providing an annular track for shell rims and said annular track terminates at an end ramp and the flat rear plate including a second annular groove aligned with the first annular groove, said second annular groove receiving a shell end opposite said rim, a rotatably mounted cog wheel having cut out grooves sized to engage shells for carrying shells along the annular track, and a spring for rotating the cog wheel such that shells can be loaded into the magazine against a force generated by said spring and dispensed by said spring, a follower arm having a first end pivotably mounted on said cog wheel and said follower arm having a second end carrying a body carried in one of said first and second annular grooves, said body defines a cut-away for communication with said cog wheel.

7. The gun drum magazine as recited in claim 6, wherein said front plate includes a slot that cooperates with a projection on a gun to support said magazine on a gun.

8. The gun drum magazine as recited in claim 6, wherein said end ramp connects to a gun, and shells exit said magazine through said end ramp.

9. The gun drum magazine as recited in claim 6, wherein said body is rotatable with said cog wheel and wherein said body is rotatable within said first and second annular grooves.

10. A shotgun drum magazine for supplying shotgun shells to a shotgun, said shotgun drum magazine comprising:

a housing having a flat front and a flat rear plate connected and separated by spacers, the flat front plate including a first annular groove providing an annular track for shell rims and said annular track terminates at an end ramp and the flat rear plate including a second annular groove aligned with the first annular groove, said second annular groove, receiving a shell end opposite said rim, said first and second annular grooves forming a path along which shells travel, said front plate further including a fixed axle contained in a spring retainer housing, a rotatably mounted cog wheel having cut out grooves sized to engage the shells for carrying the shells along the path, and a coil spring disposed within said spring retainer housing and attached to said fixed axle for rotating the cogwheel such that shells can be loaded into the magazine against a force generated by said spring and dispensed by said spring, wherein said cog wheel includes a body that defines a cut-away for communication with said cog wheel, wherein said body is carried in said first and second annular grooves and wherein said body is rotatable within said first and second annular grooves.

11. The shotgun drum magazine as recited in claim 10, wherein said body is carried on an end of an arm pivotably mounted to said cog wheel.

12. The shotgun drum magazine as recited in claim 10, wherein said cog wheel includes a follower arm, said follower arm having a first end mounted on said cog wheel and said follower arm having a second end carrying a said body carried in one of said first and second annular grooves.

13. The shotgun drum magazine as recited in claim 12, wherein said front plate includes a slot that cooperates with a projection on a shotgun to support said magazine on a shotgun.

14. The shotgun drum magazine as recited in claim 12, wherein said end ramp connects to a gun, and shells exit said magazine through said end ramp.

15. A shotgun drum magazine for supplying shotgun shells to a shotgun, said shotgun drum magazine comprising:

a housing having a flat first and a flat second plate connected and separated by spacers separated by openings, said second plate defining a track for receiving a rim of a shell, wherein said track connects to an end ramp, the first plate including a first annular groove providing an annular track for shell rims and said annular track terminates at an end ramp and the second plate including a second annular groove aligned with the first annular groove, said second annular groove receiving a shell and opposite said rim, said first and second annular grooves forming an annular path along which shells travel, a rotatably mounted cog wheel having cut out grooves sized to engage the shells for carrying the shells along the annular path, a coil spring for rotating the rotatably mounted cog wheel such that shells can be loaded into the magazine against a force generated by said spring and dispensed by said spring, and a follower body that defines a flat surface for communication with said cog wheel, said follower body carried in one of said first and second annular grooves.

16. The shotgun drum magazine as recited in claim 15, wherein said end ramp connects to a gun, and shells exit said magazine through said end ramp.

17. The shotgun as recited in claim 15, wherein said first plate includes a slot that cooperates with a projection on a shotgun to support said magazine on a shotgun.

* * * * *